US005117604A

United States Patent [19]

Bly et al.

[11] Patent Number: 5,117,604

[45] Date of Patent: Jun. 2, 1992

[54] REFRACTORY BRICK WALL SYSTEM

[75] Inventors: Lloyd G. Bly, Mokena, Ill.; Robert J. Pena, Staten Island, N.Y.; Kenneth L. Farrell, Frankfort, Ill.; Steven V. Egert, Crown Point, Ind.

[73] Assignee: M.H. Detrick Co., Mokena, Ill.

[21] Appl. No.: 668,733

[22] Filed: Mar. 12, 1991

Related U.S. Application Data

[63] Continuation of Ser. No. 371,615, Jun. 26, 1989, abandoned.

[51] Int. Cl.[5] ..... E04B 1/38; E04C 1/40

[52] U.S. Cl. ..... 52/509; 52/511; 110/336

[58] Field of Search ..... 52/486, 487, 506, 509, 52/564, 568, 410, 378, 511; 110/336, 339

[56] References Cited

U.S. PATENT DOCUMENTS

| | | | |
|---|---|---|---|
| 1,870,721 | 8/1932 | Foltz | 52/486 |
| 2,109,942 | 3/1938 | Dee | 52/509 |
| 2,879,660 | 3/1959 | Reintjes | 52/509 |
| 3,132,447 | 5/1964 | Hosbein | 52/486 |
| 3,181,278 | 5/1965 | Jones | 52/509 |
| 3,302,256 | 2/1967 | Hinchliffe | 52/378 |
| 3,376,681 | 4/1968 | Demaison | 52/511 |
| 3,763,796 | 10/1973 | Venable | 110/336 |

FOREIGN PATENT DOCUMENTS

| | | | |
|---|---|---|---|
| 732540 | 6/1966 | Canada | 52/250 |

*Primary Examiner*—James L. Ridgill, Jr.
*Attorney, Agent, or Firm*—Wood, Phillips, VanSanten, Hoffman & Ertel

[57] ABSTRACT

A refractory brick wall system for towers and the like which includes an outside casing and a plurality of bricks laid up in a pattern on the inside of the casing. Tie-back devices secure the bricks to the casing and allow for relative horizontal and relative vertical movement between the bricks and the casing. A plurality of shelves are fixed to the inside of the casing at vertically spaced intervals to provide support for the bricks in vertical sections thereof. A lightweight, insulating refractory material is cast between the casing and the bricks. The bricks themselves are shaped with ring and groove sides for interlocking of the bricks in a laid-up wall construction thereof.

15 Claims, 4 Drawing Sheets

FIG. 4
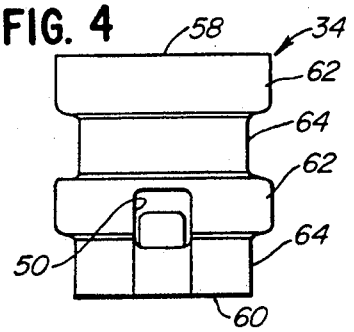
FIG. 3
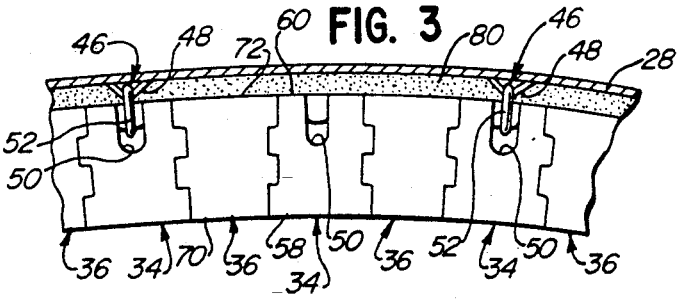
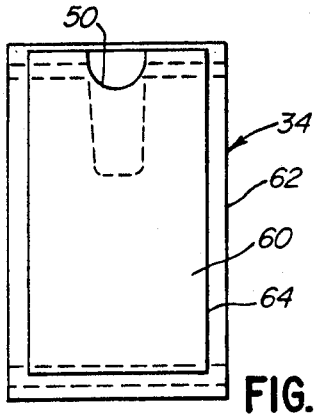
FIG. 5
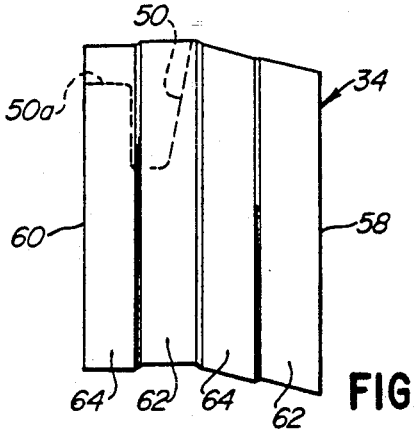
FIG. 6
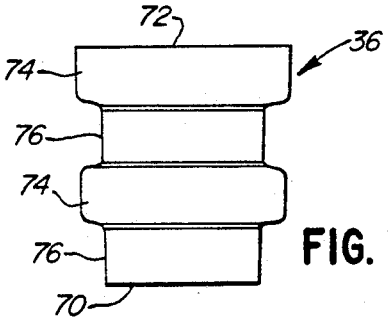
FIG. 7
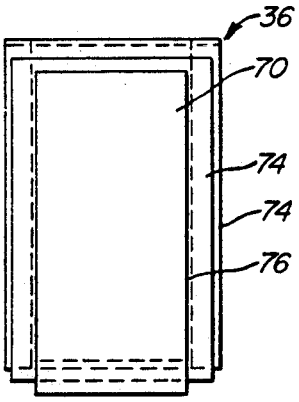
FIG. 8
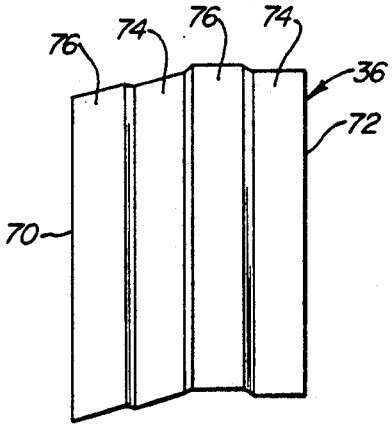
FIG. 9

REFRACTORY BRICK WALL SYSTEM

This application is a continuation of application Ser. No. 07/371,615, filed 6-26-89 now abandoned.

FIELD OF THE INVENTION

This invention generally relates to refractory wall systems and, particularly, to a refractory brick wall system for towers and the like.

BACKGROUND OF THE INVENTION

Gas conditioning or cooling towers are used in waste incineration systems, whether household or hazardous, and have become important in the growing chemical waste area. Such cooling towers often are constructed with an interior tile or brick wall design. The towers usually are cylindrical in configuration, but a circular cross configuration is not absolutely limiting. Such towers also are applied to quench and cooling chambers in existing incineration systems.

The tile or brick wall design of such structures are refractory in nature because of exposure to various conditions such as high temperature, moisture, an acid atmosphere, turbulent air flow and in applications of fluidized bed reactors. Such structures also must be capable of being installed vertically, horizontally or at an angle, and they must be used in both stationary and transportable applications. Consequently, the invention is shown herein as applied to a vertical cylindrical cooling tower but it should be understood that this is but for illustration purposes only and the terms "vertical" or "horizontal" herein and in the claims hereof should not be limiting but exemplary in description only.

Because of the type of environment described, various problems are encountered and various needs must to be fulfilled in designing a refractory brick wall system for towers and the like. For instance, there is an excess refractory weight which builds up from slagging on the wall elevation which must be relieved in order to allow higher walls to be constructed. Stresses from refractory thermal growth must be relieved or eliminated. It would be desirable to provide for some vertical and horizontal growth freedom of movement in the refractory brick wall during heat-up and to allow for thermal expansion and contraction during use. It would be desirable to facilitate repair of the refractory wall in a sectionalized manner to avoid having to remove and/or replace large areas of the brick wall. It would be desirable to provide some form of positive structural tie-back of the refractory bricks while still allowing for freedom of thermal movement within the refractory wall.

The wall design also should be virtually airtight and prevent penetration of corrosive gases and condensation. The wall design also should be of an insulating construction.

These many and varied problems, considerations and needs cause many dilemmas in designing an appropriate refractory brick wall system and constant efforts are being made to improve such structures, particularly in the ever-expanding field of waste incineration. This invention is directed to solving the above problems and dilemmas and satisfying the above and other needs in this field.

SUMMARY OF THE INVENTION

An object, therefore, of the invention is to provide a new and improved refractory brick wall system for towers and the like.

In the exemplary embodiment of the invention, the system includes an outside casing, such as a cylindrical steel outside wall. A plurality of bricks are laid up in a pattern on the inside of the casing. Tie-back means are provided for securing the bricks to the casing. The tie-back means include means for allowing both relative horizontal movement and relative vertical movement between the bricks and the casing.

In the preferred embodiment of the invention, the tie-back means include a plurality of angle brackets having distal ends fixed to the inside of the casing. Generally U-shaped arms cooperate with the brackets and the bricks to afford both horizontal pivoting of the arms and vertical sliding of the arms relative to both the brackets and the bricks to allow for thermal movement of the bricks. Specifically, each U-shaped arm has one leg slidably and pivotally received in a respective bracket, while the other leg of the U-shape is freely received in a recess in one of the bricks.

As shown herein, a plurality of the aforedescribed tie-back devices are arranged in vertically spaced horizontal rows, with the tie-back devices in one row being horizontally offset relative to the tie-back devices in an adjacent row. The bricks themselves are interlocked such that the horizontally and vertically spaced tie-back devices are effective to tie the entire refractory brick wall back to the steel casing, while allowing thermal movement of the wall relative to the casing.

Another feature of the invention is the provision of shelf means fixed to the inside of the casing at vertically spaced intervals to provide support for the bricks in vertical sections thereof. In the preferred embodiment, the shelf means is in the form of generally L-shaped shelf members with one leg of the L fixed to the casing means and the other leg of the L projecting from the casing means, such as between horizontal joints of horizontal rows of refractory bricks. Such shelf means not only relieve excess refractory weight build-up from slagging on the wall elevation and virtually eliminate stresses from refractory thermal growth, but the spaced shelf members allow for sectional repair of the refractory brick wall.

A further feature of the invention includes a castable filler means between the casing means and the bricks. The filler means is of a lightweight refractory material having insulating value for resistance to heat passage through the construction. The filler means reduces refractory cold-faced temperature and provides a barrier for gas and condensation penetration to the steel casing structure.

The refractory bricks themselves are of an interlocking design of at least two species having peripheral rings on the sides thereof. The rings of one species of brick define a shape that is a mirror image of the shape of a brick of the other species to provide interlocking means between the bricks when laid up side-by-side. Specifically, each brick has a generally flat inner face, a generally flat outer face and side faces defining the interlocking rings. The inner face of one of the species of brick is narrower than the inner face of the other species of brick, and the inner face of the other species of brick is defined by one of the peripheral rings. The inner and outer faces of the bricks are generally parallel (i.e. generally vertical in a tower construction), with the side faces of the bricks being oblique to the inner and outer faces in such a manner as to angle downwardly and inwardly toward the center of a tower construction, for instance. This helps to minimize condensation and gas penetration through the joints of the refractory bricks because liquids, particularly, seek their lowest level and will flow inwardly and downwardly of the wall structure.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 3 is a fragmented horizontal section through a portion of the outer casing, at a horizontal joint between the refractory brick, to show the brick configuration and the tie-back means;

FIG. 4 is a top plan view of one species of refractory brick according to the invention;

FIG. 5 is a rear elevational view of the brick of FIG. 4;

FIG. 6 is a side elevational view of the brick of FIG. 4;

FIG. 7 is a top plan view of a second species of refractory brick according to the invention;

FIG. 8 is a front elevational view of the brick of FIG. 7;

FIG. 9 is a side elevational view of the brick of FIG. 7;

DETAILED DESCRIPTION OF THE PREFERRED EMBODIMENT

Figure 1:
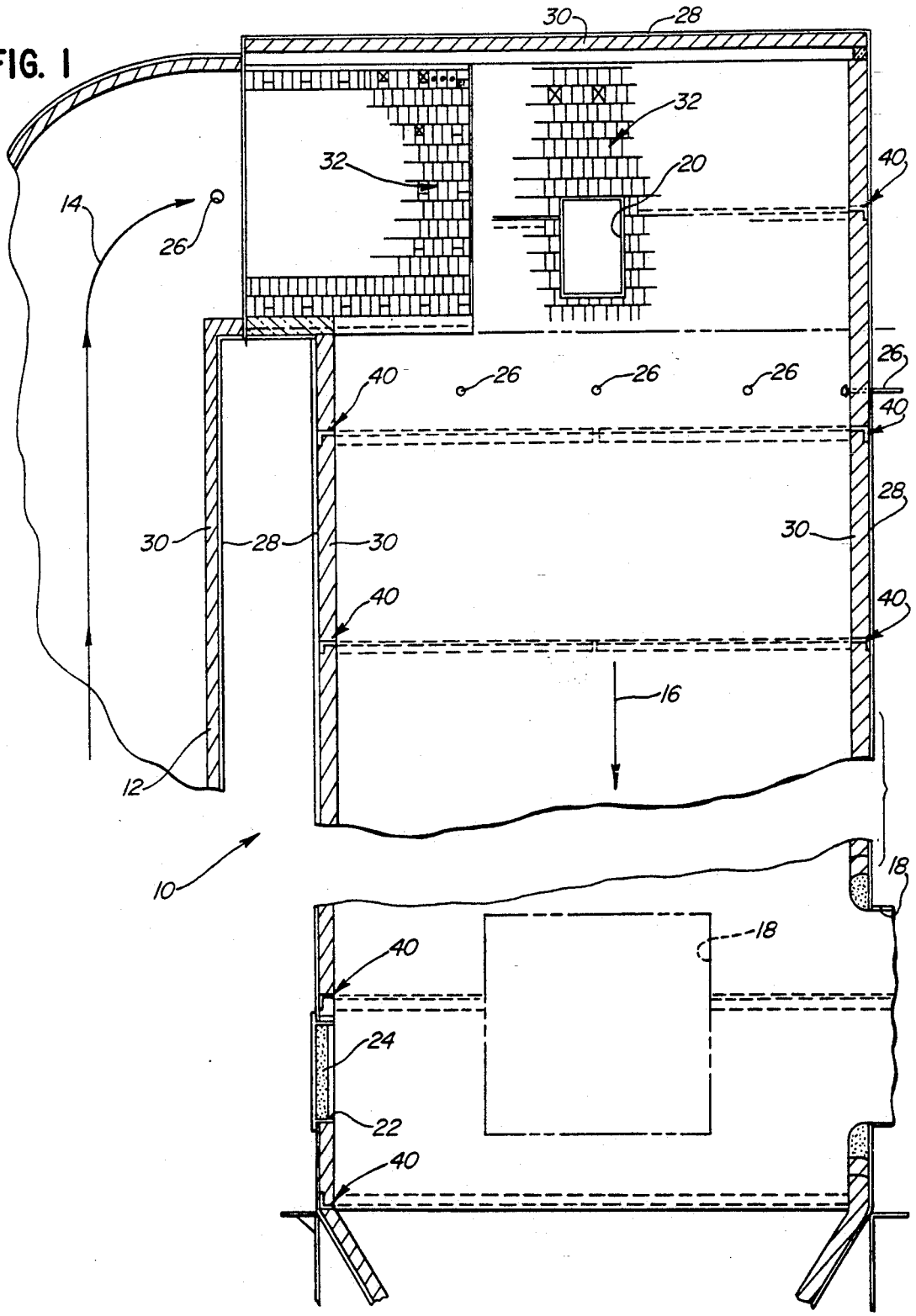
FIG. 1 is a vertical section, partially broken away and somewhat schematically illustrated, of a general configuration of a cooling tower embodying the refractory brick wall system of the invention.

Referring to the drawings in greater detail, and first to FIG. 1, a cooling tower, generally designated 10, is generally shown to exemplify one use of the refractory brick wall system of the invention and to generally illustrate locations for certain features of the system. Such a cooling tower might be used as a gas conditioning/cooling tower in a waste incineration system, either for household, commercial or hazardous applications. However, as stated above, this depiction is for illustration purposes because the refractory brick wall system of the invention can be installed in vertical, horizontal or oblique applications; in both fixed, stationary or transportable applications; and in existing quench and cooling chamber applications. as well as a wide variety of other refractory wall uses.

Cooling tower 10 includes an inlet duct 12 for incoming gas flow, as indicated by arrows 14, whereby the gas will flow downwardly through the tower, in the direction of arrow 16. The gas may flow out of the bottom of the tower, or one or more cross over ducts 18 may be provided near the bottom of the tower leading to other such units. An access door 20 may be provided to gain access to the interior of the tower near the top thereof. A second access door 22 may be provided near the bottom of the tower and covered by a castable refractory closure 24. As is sometimes common, spray nozzles 26 may project through the tower near the top thereof.

Generally, the invention contemplates a refractory brick wall system which includes an outside casing 28 of steel or other like appropriate material and a brick wall 30 formed of a plurality of refractory bricks laid up in a pattern on the inside of steel casing 28. In order to facilitate the illustration of FIG. 1, the majority of brick wall 30 is simply shown sectioned in the vertical sectional depiction of the figure However, it can be seen that areas, generally designated 32, near the top of the tower have been completed to show a pattern of refractory bricks which, if the depiction was completed, would cover substantially the entire interior surface of tower 10 (i.e. the surface exposed to the gas flow). Only sections 32 have been magnified in order to facilitate the illustration of other components of the tower and certain features of the invention as described hereinafter.

Figure 2:
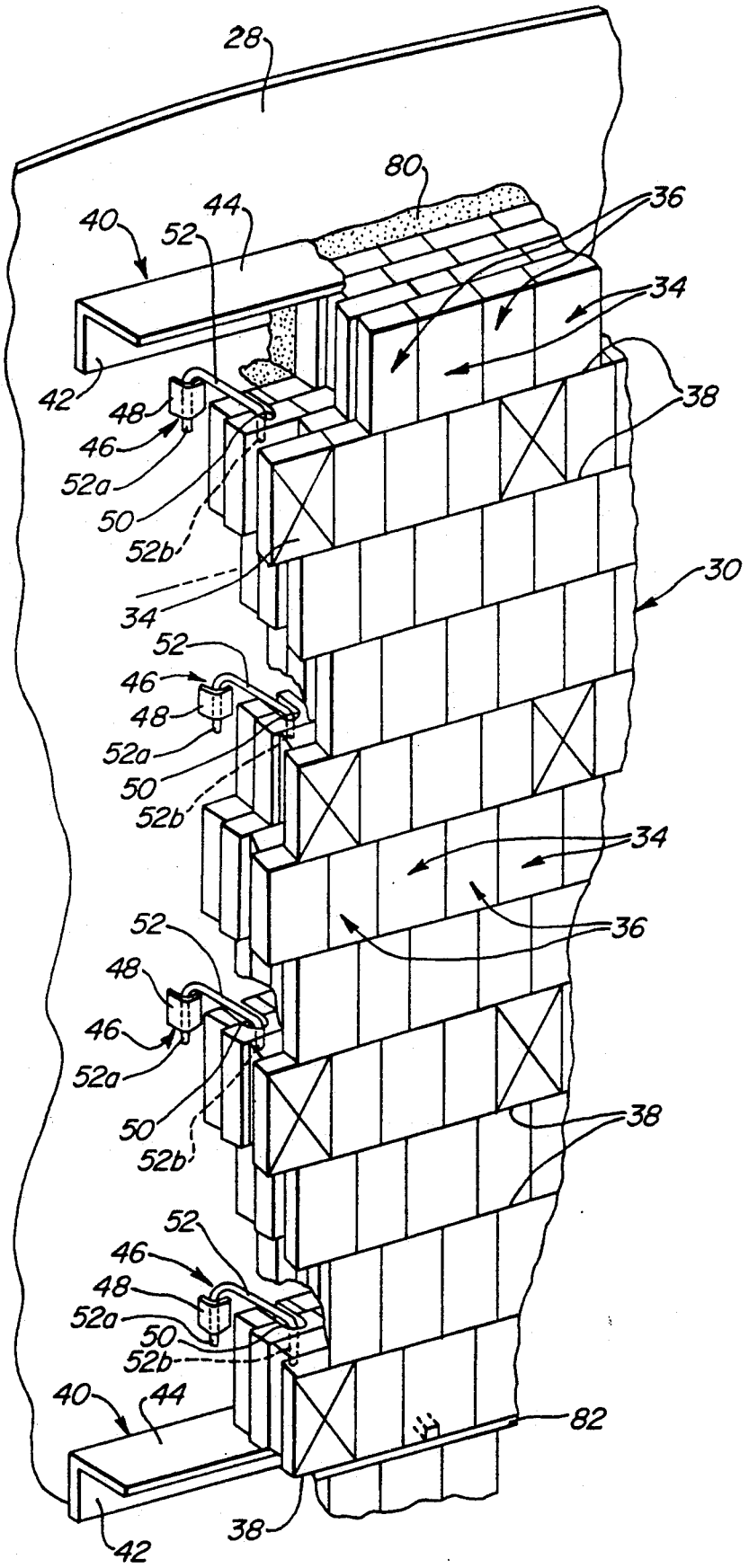
FIG. 2 is a fragmented, perspective view of a section of the refractory brick wall system, as viewed from the inside of the cooling tower.

Turning now to FIG. 2, a fragmented section of steel casing 28 is shown with a portion of brick wall 30 and its plurality of bricks laid up in a pattern on the inside of the casing. As will be more clear in the description of FIGS. 4–9, it can be seen in FIG. 2 that there are more than one species of brick. In the exemplary embodiment of the invention, two species of brick are used and generally designated 34 and 36. Suffice it to say at this point, it can be seen, for instance, in the top row of bricks shown in FIG. 2, that the inner faces of bricks 34 are wider than the inner faces of bricks 36 The reasons for this will be set forth in greater detail hereinafter. However, it can be seen that the bricks are laid up in horizontal rows at horizontal joints 38.

One feature of the invention is the provision of shelf means, generally designated 40, fixed to the inside of casing 28 at vertically spaced intervals to provide support for the bricks in vertical sections thereof. Referring briefly back to FIG. 1, shelf means 40 are shown vertically spaced substantially the entire height of cooling tower 10.

More particularly, referring back to FIG. 2, shelf means 40 are in the form of a plurality of horizontal shelf members, such as of steel or the like, having L-shapes with one leg 42 of the L fixed to casing 28, as by welding, and the other leg 44 of the L projecting inwardly from the casing and disposed in a horizontal joint 38 between horizontal rows of bricks 34,36. This shelf means sectionalizes the interior wall structure of tower 10 (or other appropriate wall construction) and allows for ease of repair of the wall system for replacement of a certain number of bricks without affecting the entire wall system. The shelving relieves excess refractory weight build-up from slagging, accumulating on the inside of the wall construction and, thereby, allows higher walls to be constructed within given parameters of the other components of the system. The shelving also virtually eliminates stresses from refractory thermal growth of the wall.

Another feature of the refractory brick wall system of the invention is the provision of tie-back means for securing bricks 34,36 to casing 28, while allowing for relative horizontal and relative vertical movement between the bricks and the casing. Before proceeding with a detailed description of the tie-back means, it should be understood that all of the bricks are interlocked on all sides, tops and bottoms, again as described hereinafter in relation to FIGS. 4–9.

More particularly, the tie-back means include a plurality of tie-back devices, generally designated 46, as best seen in FIG. 2. Each tie-back device includes an angle bracket 48 which defines angled legs, the distal edges of which are fixed, as by welding, to the inside of casing 28. In essence, these angle brackets define vertically oriented slots or recesses. Although all of bricks 34 are fabricated identically, selected ones of this species of brick are shown in FIG. 2 with an "X" across the inner face thereof. This simply is to show in FIG. 2 the various locations of the tie back devices 46 behind the bricks. Each brick 34 is formed with a vertically oriented recess 50 opening at the top thereof. Therefore, it can be seen that brackets 48 and brick recesses 50 define horizontally spaced, vertically and upwardly opening recess means.

Tie-back devices 46 include arm members 52 which are generally U-shaped to define legs 52*a* and 52*b* for positioning in brackets 48 and brick recesses 50, respectively. Therefore, it can be seen that the complementary function of brackets 48 and recesses 50 in conjunction with the legs 52*a*, 52*b* of arms 52 provide for both horizontal pivoting (with the legs 52*a*, 52*b* defining pivot axes) as well as vertical sliding between the interlocked brick wall and casing 28. This allows for both horizontal and vertical growth freedom of movement of the brick wall during heat-up and allows for thermal expansion and contraction of the refractory brick wall while still tying the entire wall back to fixed casing 28.

Figure 10:
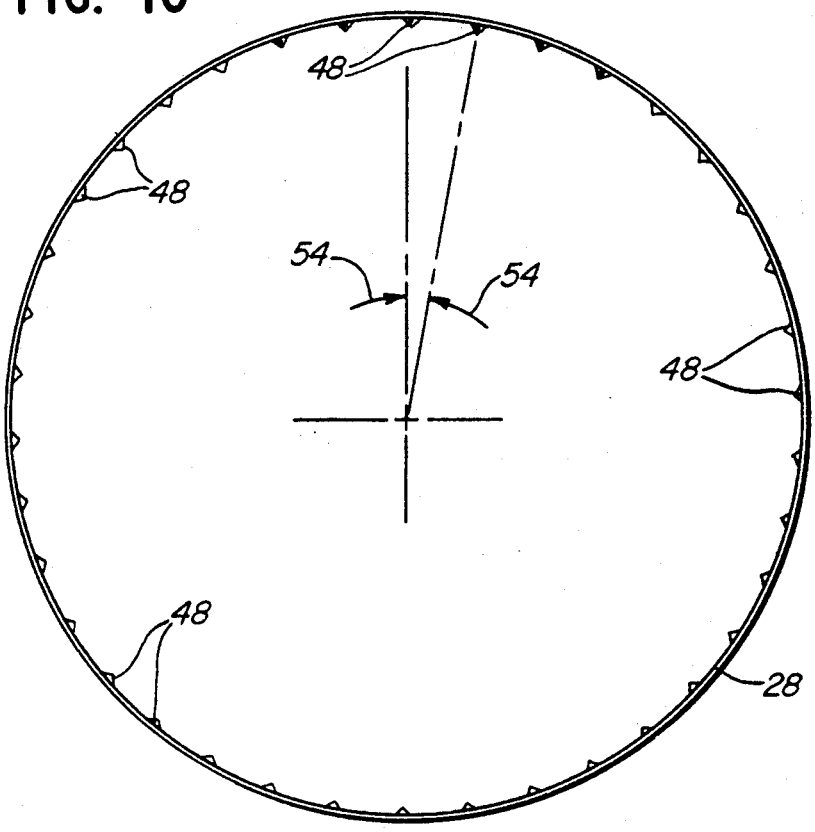
FIG. 10 is a somewhat schematic illustration of a horizontal section through the outer casing, simply to show the horizontal spacing within a circular row of the tie-back means for the refractory brick wall.
Figure 11:
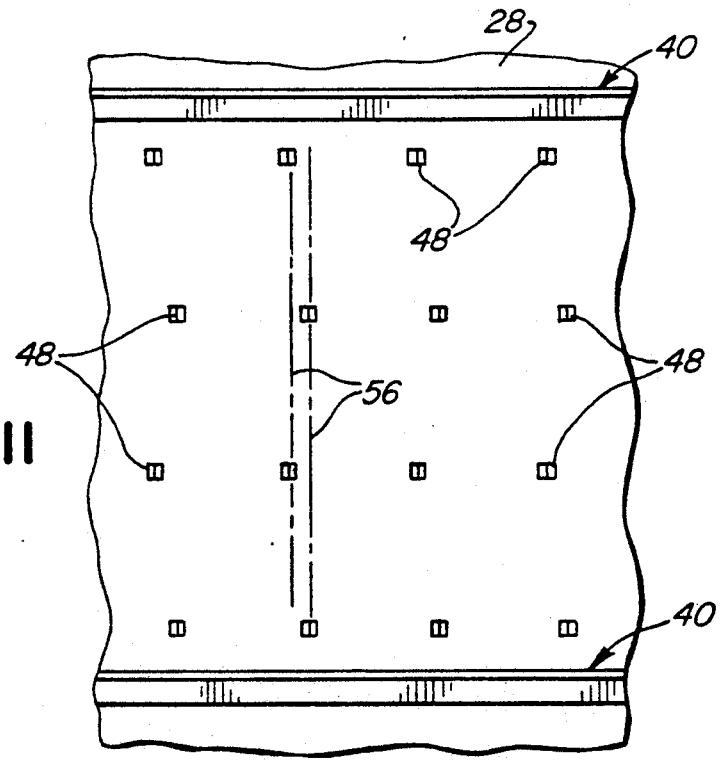
FIG. 11 is a fragmented elevational view of a section of the inside of the casing to illustrate the horizontal and vertical spacing of the tie-back means.

Referring to FIGS. 10 and 11, just the brackets 48 of tie-back devices 46 are shown on the inside of casing 28. FIG. 10 shows that the tie-back devices are spaced horizontally or angularly in any horizontal given row thereof a distance as indicated by angle-designation arrows 54. FIG. 11 shows that the tie-back devices are disposed in vertically spaced, horizontal rows about the interior of casing 28. In addition, it can be seen that the individual tie-back devices in one row are horizontally offset relative to the tie-back devices in an adjacent row, as indicated by phantom lines 56. The offset rows give even distribution of structural load back to the steel casing. This staggering also reduces the required number of tie-back devices without significantly decreasing the structural strength of the construction. It also enhances a unified effect on the overall refractory brick wall to hold the bricks together in view of the interlocked design of the bricks themselves.

To this end, FIG. 3 shows a pair of tie-back devices 46 in conjunction with a plurality of surrounding bricks 34,36. It can be seen that, although a tie-back device is not used with every brick 34, the combination of the tie-back devices and the interlocking nature of bricks 34 and 36 cooperate to tie the entire brick wall construction back to casing 28.

FIGS. 4–6 show the configuration of each of bricks 34, i.e. one species of brick. More particularly, each brick 34 has an inner face 58 (i.e. facing the inside of the tower), an outer face 60 and sides defined by peripheral rings 62 defining grooves or recesses 64. Inner and outer faces 58 and 60, respectively, are flat and generally parallel. Recess 50 for receiving leg 52*b* of one of the tie-back arms 52 also are shown in these views. In particular, FIG. 6 shows that recess 50 actually has a step portion 50*a* which is recessed below the top of the brick so that the arm 52 can be recessed below the joint between the brick and a mating brick. In a cooling tower application, inner and outer faces 58 and 60 would be generally vertically oriented. FIG. 6 also shows that the top and bottom of brick 34 are angled downwardly toward inner face 58 oblique to the vertical orientation of the inner surface of the wall construction, i.e. the vertical axis of tower 10, for instance. This minimizes condensation and gas penetration through the joints between the refractory bricks, particularly at the horizontal joints. As is known, liquids will seek their lowest levels which, in this configuration, would be the center of the cooling tower.

FIGS. 7–9 show the configuration of the second species of brick, generally designated 36. Each brick in this species has an inner face 70, an outer face 72 and side faces defined by rings 74 forming grooves 76. Although it should be clear from comparing FIG. 7 with FIG. 4, FIG. 3 best shows that the ring and groove configuration of bricks 34 and 36 are such as to be mirror images of each other. In other words, the rings of bricks 34 mate with the grooves of bricks 36 to provide a substantially airtight mating between adjacent bricks. Of course, as stated at times above, this also provides for absolute interlocking of the two species of bricks throughout the entire brick wall construction.

These configurations of bricks 34, 36 provide the total tile with a grooved and ribbed affect. This allows an extra measure of interlocking, to insure that there is no moisture or gas penetration back to the casing. A further feature of the invention is to include filler means 80 (FIGS. 2 and 3) of a homogeneous lightweight refractory material which can be poured and cast between the inner faces 60 and 72 of bricks 36 and 34, respectively, and outer steel casing 28. This filler material provides improved insulating value for resistance to heat passage through the construction. It reduces refractory cold face temperature, and it also is a barrier to gas penetration to the steel casing 28 as with the bricks themselves, as well as the mortar (not shown) between the bricks, this mortar or filler material experiences expansion and contraction in all directions. Internal recesses 50 insure an allowance for vertical and horizontal growth freedom (i.e., expansion and contraction).

Lastly, at a joint 82 (FIG. 2) formed by legs 44 of shelf means 40, a mortar is used to fill the joint. For instance, in a "wet" application such as a spray chamber, an acid resistant mortar is used to seal off the joint and to keep any moisture from entering the joint. In a high temperature application, such as a chemical waste incinerator, a chronic fiber may be used in the joint, packed tight to prevent gases from penetrating into the joint.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

We claim:

1. A refractory brick wall comprising:

an outside casing;

a plurality of bricks laid up in a pattern on the casing, at least some of the bricks having preformed recesses, a plurality of said bricks having inner and outer faces, spaced side faces, and top and bottom faces; and tie-back means for securing the bricks to the casing with the outer brick faces facing the casing and allowing relative horizontal and vertical movement between the bricks and the casing, there being a leg on each tie-back means loosely received in said recesses, a plurality of said bricks having means for interlocking each said brick with a plurality of adjacent bricks to prevent the interlocked bricks from moving relative to each other away from the casing, said interlocking means comprising cooperating rings and recesses on each of the side, inner and outer faces of certain of said bricks and each of the bricks immediately above, below, and on the sides of the certain of said bricks, the upper surfaces of a plurality of said bricks being angled downwardly toward the inner face to cooperate with the bottom face of overlying bricks having bottom surfaces similarly angled downwardly from the outer faces toward the inner faces thereof, said upper surfaces that are angled downwardly minimizing condensation and gas penetration between adjacent bricks.

2. The refractory brick wall of claim 1 wherein said tie-back means includes a pivot structure between the bricks and the casing.

3. The refractory brick wall of claim 2 wherein said pivot structure includes a bracket fixed to the casing and a pivot arm connected to the bricks and pivotably mounted on the bracket.

4. The refractory brick wall of claim 3 wherein said pivot arms are generally U-shaped with one leg of the U disposed in a recess in the bricks and another leg of the U defining with the bracket the pivot axis of the pivot structure.

5. The refractory brick wall of claim 1 wherein said tie-back means includes a plurality of spaced tie-back devices arranged in vertically spaced horizontal rows.

6. The refractory brick wall system of claim 5 wherein said tie-back devices in one row are horizontally offset relative to the tie-back devices in an adjacent row.

7. The refractory brick wall of claim 1 including shelf means fixed to the inside of the casing at vertically spaced intervals to provide support for the bricks in vertical sections thereof.

8. The refractory brick wall of claim 7 wherein said shelf means comprise horizontal shelf members projecting from the casing between horizontal rows of bricks for supporting sections of bricks thereabove.

9. The refractory brick wall system of claim 8 wherein said shelf members are generally L-shaped with one leg of the L fixed to the casing and another leg of the L projecting from the casing.

10. The refractory brick wall of claim 1 including a castable filler between the casing and the bricks.

11. The refractory brick wall of claim 10 wherein said filler is of lightweight refractory material.

12. The refractory brick wall system of claim 11 wherein said filler is of insulating material.

13. The refractory brick wall system of claim 1 wherein a plurality of said bricks have rings and recesses each extending continuously around the side, top and bottom faces.

14. The refractory brick wall system of claim 13 wherein there are two species of bricks having said rings and recesses and the rings of one species of bricks define a shape that is a mirror image of the shape of a brick of the other species.

15. The refractory brick wall system of claim 14 wherein the inner face of one of said species of brick is narrower than the other species of brick, the inner face of the other species of brick being defined by one of said peripheral rings.

* * * * *